US005149138A

United States Patent [19]

Zemsky

[11] Patent Number: 5,149,138

[45] Date of Patent: Sep. 22, 1992

[54] METHOD OF APPLYING A FLUORESCENT MARKING COMPOSITION

[76] Inventor: Michael D. Zemsky, P.O. Box 677, Gainesville, Va. 22065-0677

[21] Appl. No.: 572,564

[22] Filed: Aug. 27, 1990

Related U.S. Application Data

[63] Continuation-in-part of Ser. No. 454,623, Dec. 21, 1989, abandoned, which is a continuation-in-part of Ser. No. 280,481, Nov. 18, 1988, abandoned.

[51] Int. Cl.[5] ..... B42D 15/00

[52] U.S. Cl. ..... 283/70; 283/92; 252/301.28

[58] Field of Search ..... 252/301.26, 301.28, 252/301.24; 427/7, 154, 157; 283/92

[56] References Cited

U.S. PATENT DOCUMENTS

| | | | |
|---|---|---|---|
| 3,066,105 | 11/1962 | McCafferty | 252/301.35 |
| 3,169,129 | 2/1965 | Rodgers et al. | 252/301.16 |
| 3,753,647 | 8/1973 | Molina | 252/301.19 |
| 3,768,968 | 10/1973 | van der Eltz et al. | 8/491 |
| 3,812,052 | 5/1974 | Weston | 252/301.35 |
| 3,899,450 | 8/1975 | Molina | 252/301.19 |
| 3,960,755 | 6/1976 | Beachem et al. | 252/301.16 |
| 4,758,366 | 7/1988 | Parekh | 252/9 |

*Primary Examiner*—John Niebling
*Assistant Examiner*—Dean Nguyen
*Attorney, Agent, or Firm*—Nixon & Vanderhye

[57] ABSTRACT

A composition for rendering materials fluorescent substantially without visible trace comprises an organic fluorescent compound dissolved in a solvent characterized by a boiling point or distillation range at atmospheric pressure of between about 12°-35° C. The preferred composition comprises fluorescent azoles, such as 2-(o-Hydroxyphenyl)benzoxazole, 2-(o-Hydroxyphenyl)benoxazole, and derivatives thereof dissolved in volatile halocarbon solvents, such as Fluorotrichlormethane, 1,1-Dichloro-1-Fluoroethane, and 2,2-Dichloro-1,1,1-Trifluoroethane. The resultant product is particularly suited for marking currency, papers, fabrics, and other porous webs and surfaces. Treated surfaces appear normal in white light, are highly fluorescent under UV light and feature excellent transfer of the fluorescent compound to fingertips and other surfaces in direct or glancing contact.

10 Claims, No Drawings

METHOD OF APPLYING A FLUORESCENT MARKING COMPOSITION

CROSS-REFERENCE TO RELATED APPLICATIONS

This application is a continuation-in-part of earlier application Ser. No. 454,623, filed Dec. 21, 1989, now abandoned which, in turn, is a continuation-in-part of application Ser. No. 280,481 filed Nov. 18, 1988, now abandoned.

BACKGROUND OF THE INVENTION

1. Field of the Invention

The present invention relates to fluorescent marking compounds and more particularly to fluorescent marking compounds which transfer to anything coming in contact with a treated surface.

2. Related Prior Art

Fluorescent compounds and marking solutions are well known in the art. Numerous powders, liquids and pastes are commercially available. Many of these products are used to impart "invisible" marks for purposes of theft detection, inventory control, quality control, tracking, document security and verification, and the like. Preferred products feature a low color profile in while light and a strong fluorescent signal under long, short or midwave ultraviolet light.

In the field of theft detection, to which the instant invention most particularly pertains, it is highly desirable to have an easily applied product which will impart both a long term, rub-out resistant, "blow-away" proof, strong fluorescent mark to the material being treated and still be capable of readily transferring to the hands of a thief upon only minimal contact and in a quantity sufficient to ensure that the fluorescent residue is easily detectable on the thief's fingers when examined under low-powered UV light. Such a fluorescent compound is ideally noncolor-contributing under white light examination and must not impart undesirable or unusual textural properties, such as a stiff, gritty or greasy feel.

While dry organic and inorganic fluorescent powders can be applied by brushing, rubbing or otherwise distributing them over the paper's surface so to minimize any sign of treatment under white light examination, these techniques are time consuming, messy and uneconomical, and are incapable of efficiently and uniformly marking every square millimeter of a dollar bill, for example. As a practical matter, it is unrealistic for investigators to treat large amounts of currency, such as might be involved in a ransom operation, in such a manner. Furthermore, these application methods typically leave a gritty feel because conventional grinding and milling techniques are generally capable of economically providing powders having diameters in the submicron range. In those cases when finelydivided organic powders are available, normal storage results in undesirable clumping and aggregation. The most critical shortcoming of this approach, however, is the nonpermanent nature of the markings: they may be rubbed off or blown away by bursts of compressed gas, as virtually none of the fluorescent organic compound penetrates the fibrous web.

Another marking approach involves dissolving an organic fluorescent compound in a solvent and spraying or otherwise applying the solution to currency or other porous materials. Among the critical shortcomings of this technique is that most solvents carry the fluorescent compound into the web and little, if any, powder is available on the surface for ready transfer to a thief's fingers, pockets, wallet, or other surfaces. Thus it will be seen that merely dissolving an organic fluorescent compound in an organic solvent does not provide a product having optimum, or even satisfactory, transfer capabilities. This limitation can be overcome by utilizing solvents characterized by a narrowly defined boiling point range in combination with dissolved fluorescent agents at specified concentrations, as described herein.

Another approach involves dispersing an inorganic phosphor or organic fluorescent compound in a solvent and spraying or otherwise applying the mixture to currency or other surfaces. In such a system the fluorescent phosphor or compound is insoluble or very substantially insoluble in the solvent. An example of such an approach would be a mixture of an inorganic zinc sulfide-based fluorescent phospor in 1,1,1-Trichloroethane or methyl ethyl ketone, two common volatile solvents. A serious shortcoming of this approach is that most of the fluorescent compound is deposited on the surface of the currency, where it is easily blown or wiped away. Additionally, the application is usually uneven, often gritty, and is almost always noticeable to a thief. Further disadvantages of this approach include the easy visibility without a UV light of the fluorescent compound, and the limitation of having to treat each bill or surface individually, as it is extremely difficult to maintain particles in uniform suspension without the use of various nonvolatile processing aids. Thus it will be seen that merely dispersing an organic or inorganic fluorescent compound in a solvent will not cause the treated surface to be permanently marked, because the fluorescent powder, which is insoluble in the solvent, cannot adequately infiltrate the paper web.

The use of fluorescent solutions is described in the patent literature. U.S. Pat. No. 3,812,052 to Weston and 3,960,755 to Beachem, et. al. describe compositions consisting of fluorescent compounds dissolved in solvents characterized by a diverse range of boiling points, including polar solvents such as water and butyl formate which would cause paper to swell. Each of these patents teaches the use of a resin or polymer dissolved in the solvent, rendering them unsuitable for the surreptitious marking of paper webs as taught in the instant invention. U.S. Pat. Nos. 3,753,647 and 3,899,450 to Molina teach a dye penetrant for detecting flaws and defects on nonporous metal surfaces comprising fluorescent dyes and volatile halocarbon solvents in combination with substantially higher-boiling ketone or alkyl pyrrolidone solvents and nonvolatile nonionic surfactants, which agents would stain paper and impart a greasy character. The use of novel fluorescent compounds in various coating and printing vehicles is described in U.S. Pat. Nos. 3,169,129 to Rodgers, et. al. and 3,066,105 to McCafferty.

SUMMARY OF THE INVENTION

Surprisingly, it has been found that a solution containing between 0.05–2.5 (g of fluorescent compound in 100 ml of solvent), and most preferably about 0.05–1.4 of selected fluorescent dissolved in volatile halocarbon solvents is capable of both marking the paper or other fibrous web in a substantially permanent fashion which resists attempts to remove the powder by rubbing or applying a stream of compressed gas, yet provides for excellent transfer of the fluorescent compound in response to the lightest touch. The system can be quickly and easily applied to hundreds of bills in minutes by pouring or immersion. Advantageously, no grit or unusual feel is imparted to treated materials. Of critical importance, treatment of most papers can be quickly accomplished by an unskilled operator so that the marking is undetectable in white light to the unaided eyes, yet provides a very strong fluorescent signal under long, short or midwave UV light, including the lowest powered hand-held commercial models. An additional advantage is the low order of toxicity of the preferred fluorescent compounds relative to most inorganic phosphors and 8-Hydroxyquinoline chelates used in commerce. A further advantage is the excellent adhesion to skin and other surfaces as compared to inorganic phosphors and many other organic fluorescent compounds. A still further advantage of the present teachings is that a simple fluorometric field assay is available since the fluorescent emission wavelength shifts toward the blue on the application of organic or inorganic bases. Additional advantages include the speed, convenience, and uniformity of each application. The present system affords other advantages which will be apparent to those skilled in the art upon a reading of the specification and the appended claims.

DESCRIPTION OF THE PREFERRED EMBODIMENT

"Organic fluorescent compound" and "fluorescent organic compound" includes organic compounds which emit visible radiation in the spectral region of about 380–700 nanometers when irradiated by commercially available ultraviolet lights. By ultraviolet light is meant radiation between about 250–370 nanometers. Since it is an important object of the instant invention to provide a product which, on application to paper and other porous webs and surfaces, is essentially invisible to the unaided eye without UV illumination, the preferred organic fluorescent compounds will be white, off-white, colorless or nearly colorless, or otherwise essentially noncolor contributing in the dry state; however, colored fluorescent compounds are also suitable for specific applications, particularly when matched with the color of the surface to be treated.

The preferred compounds are fluorescent azoles. These include heterocycles containing nitrogen substitution, and are particularly intended to include benzoxazoles (containing nitrogen and oxygen substitution) and benzothiazoles (containing nitrogen and sulfur substitution), and their derivatives. Selected members of these classes of compounds are described, for example, in paper by David L. Williams and Adam Heller starting on page 4474 of the Journal of Physical Chemistry, Vol. 74, No. 26, 1970. Of particular interest are the compounds appearing in Table I of the cited Williams and Heller paper which have quantum efficiencies greater than 13.0. The preferred compound of this class is 2-(o-Hydroxyphenyl)benzothiazole. After several washings with ethanol and recrystallization from acetic acid, the product of commerce appears as a nearly-white crystalline powder which is characterized by a strong green fluorescent signal under UV light.

Other compounds which are suitable as the fluorescent compounds of this invention include the 2-orthohydroxyphenyl4-(3H)-quinazolinones as described in U.S. Pat. No. 3,169,129 to Rodgers and Millionis. Of particular interest are the following disclosed compounds:

2-(2-hydroxypheny)-4(3)-quinazolone;
2-(2-hydroxy-4-methoxyphenyl)-4(3)-quinazolone;
2-(3,5-dichloro-2-hydroxyphenyl)-4(3)quinazolone;
2-(5-chloro-2-hydroxyphenyl)-4(3)-quinazolone;
2-(2-hydroxy-3-methylphenyl)-4(3)-quinazolone;
2-(4-ethyl-2-hydroxyphenyl)-4(3)-quinazolone Still other compounds suitable as the organic fluorescent compounds of this invention are described in U.S. Pat. No. 3,066,105 to McCafferty. Of particular interest are the fluorescent derivatives of 2-(o-Hydroxyphenyl)-benzothiazole and 2-(o-Hydroxyphenyl)benzoxazole described in columns 3 and 4 of said patent.

Still additional compounds of interest include the coumarin derivatives which are used as laser dyes. These compounds are described in Eastman Kodak Laboratory and Research Products Catalog No. 53 on pages 106–111. Among these "laser dyes" are Coumarin 1, 2, 4, 6, 7, 30, 102, 120, 138, 151, 152, 153, 307, 314, 334, 337, 338, 339, and 343. The fluorinated coumarin derivatives, such as Coumarin 153 and 152, while color-contributing, have high quantum efficiencies and are easily soluble in halocarbon solvents.

Although not as satisfactory for identification purposes as other recited organic fluorescent compounds due to the ubiquity of blue-fluorescing compounds, the blue fluorescing solvent-soluble optical brighteners are suitable for the current invention. These include proprietary commercial products such as Uvitex® OB, a bis(benzoxazolyl) derivative; PHORWITE® BBH, a stilbene derivative; PHORWITE® K2002, a pyrazoline derivative; and although characterized by very low solubility in nonpolar solvents, LEUCOPURE-®EGM.

Another class of fluorescent compounds, although often colored under white light examination, includes conjugated polycyclic aromatic compounds which have at least 3 fused rings. These include, without limitation, anthracene, benzanthracene, phenanthrene, substituted phenanthrene, napthacene, pentacene, substituted pentacene, and derivatives thereof.

Other fluorescent compounds also may be used provided that they are soluble at room temperature in the organic solvents of the invention at concentrations of at least about 0.01% and more preferably about 0.05% on a weight/volume basis. The preferred fluorescent compounds are solids in the dry state so that as the solvents evaporate during the treatment process, the fluorescent compound will precipitate out of solution and deposit as an extremely fine powder on contact with the paper or other surface. In this way, the very finely precipitated powder is available on the surface of treated materials for ready transfer to fingertips and other surfaces. The preferred treatment processes or application methods include pouring the fluorescent marking solution over paper or fabric, dipping items to be marked into the marking solution, application by pipette or premeasured dosage syringes, by brush or fabric dauber and, less desirably, by aerosol sprayer. Additionally, the most desirable compound have a high quantum efficiency, a low order of toxicity, are nonreactive with the preferred solvents, are noncolor contributing, and have good substantivity to skin and other surfaces. Organic fluorescent compounds which are insoluble or substantially insoluble in water are advantageous in that they cannot be easily washed off once applied to a surface. Other features of the preferred organic fluorescent compounds include good lightfastness, heat stability, and fluorescent colors which are distinctly different than those found in common items of commerce (i.e. fluorescent colors other than blue). Selected fluorescent compounds may be mixed and the fluorescent solution may contain a combination of fluorescent compounds. Although most of the fluorescent compounds recited herein exhibit visible fluorescence when irradiate by long or shortwave UV light, it is within the scope of this invention to utilize fluorescent compounds which exhibit visible fluorescence only under shortwave UV or only under longwave UV or, alternately, exhibit a first color under longwave UV and a second color under shortwave UV.

In selected cases, it may be desirable to utilize as the fluorescent organic compounds of this invention, those which sublime at or slightly above room temperature. In this way tell-tale fluorescent residues will be deposited on surfaces (such as the interior of a wallet or envelope) contiguous to, or in close proximity to, the treated documents, fabrics, or other marked material. 2-(o-Hydroxyphenyl)benzothiazole and 2-(o-Hydroxy-5-methoxyphenyl)benzothiazole, along with other low molecular weight azoles, have been observed to sublime when subjected to elevated temperatures such as those expected in an automobile glove compartment during summer months.

It is also within the scope of this invention to add to the solvents, along with the fluorescent organic compound or combination of compounds, substances such as colorimetric reagents, organometallic compounds, oils and other substances which impart a characteristic taste, odor, or "vapor trail" or "signature" colored dyes, and the like. These substances also may be dissolved in the solvents of the invention without any organic fluorescent compounds, in which case marked currency and the like would not necessarily exhibit any visible fluorescence under UV light. Such compounds may also be added in addition to the fluorescent compounds of the instant invention for purposes of adding unique chemical "tags."

The preferred solvents in accordance with the teachings of this invention include those which have a boiling point or distillation range at 760mm Hg between about 12°-35° Centigrade, and most preferably between about 19°-28 C. Solvents which have boiling points or distillation ranges above about 35° C. tend to carry virtually all of the fluorescent compounds into the fibrous web or fabric fibers, leaving a negligible quantity on the surface for transfer to a thief's hands. The effect is particularly dramatic when applied under cool ambient air conditions, i.e., lower than about 65 degrees Fahrenheit. Solvents with boiling points or distillation ranges below about 15° C. tend to evaporate before even contacting the paper, resulting in marginal penetration, thereby limiting the permanent marking ability of the solution. Additionally, solvents boiling at such low temperature are generally impractical to work with, present packaging and shipping limitations, and pose a frostbite threat to unprotected skin. Nevertheless, solvents with boiling points as low as about 12 degrees C. can be useful for special cold weather applications.

So as not to damage paper sheets, the preferred solvents should be nonpolar liquids, although in limited situations such as the treatment of colorfast fabrics, moderately polar solvents, preferably used in combination with nonpolar liquids, may be considered. Highly polar and hydrogen bonded solvents are generally unsatisfactory for most purposes of this invention since their polar character as indicated by relatively high solubility parameter values will tend to swell paper fibers, thereby causing visible damage, thus minimizing the utility of the instant invention for use on paper. Further, polar and even moderately polar compounds are not preferred due to their strong tendency to cause most inks to run. A full discussion of solubility parameters, including nonpolar, moderately polar, and polar liquids is found in the CRC Handbook of Solubility Parameters and other Cohesion Parameters, 1983, by A. Barton.

Among the preferred solvents are the halocarbons, particularly chlorofluorocarbons and hydrochlorofluorocarbons. These solvents typically have low toxicity profiles, very low surface tension values, low solubility parameter values, relatively low solvent power values (i.e., low Kauri-Butanol values), pose little or no fire risk and tend to be volatile below their literature boiling points. One chlorofluorocarbon which is particularly advantageous in the practice of the instant invention is Fluorotrichloromethane, which is sold under the tradenames FREON® 11 AND GENETRON® 11. This solvent has been extensively studied and is characterized by a low order of toxicity and is nonreactive with the organic fluorescent compounds of this invention. Substitutes for this compound which are believed to have less tendency to degrade the earth's protective ozone layer include fluorocarbons 123(CH2FCF3) and 141b(CH3CCL2F) and other developmental products, as described, for example, in Chemical & Engineering News, Vol. 66(1988), No. 6, pp 17-20, which is incorporated herein by reference.

Additional volatile organic solvents which are useful in accordance with the practice of this invention, alone or in combination with other solvents to achieve the necessary degree of solvency to dissolve desired amounts of organic fluorescent compounds, include without limitation:

| | BP @ 760 mm Hg 21-22° C. |
|---|---|
| 1,2-Dichloro-1,2-difluoroethylene | 19 |
| 1,1-Dichloro-1,1-difluoroethylene | 28 |
| 1,2-Dichlorotrifluoroethane | 30 |
| 3,3,4,4,5,5,5-Heptafluoropentene-1 | 26 |
| 2,2,2-Trifluoroethyl bromide | 27 |
| 2,2-Dichloro-1,1,1-trifluoroethane | 28 |
| 1-Chloro-1,1,3,3,3-pentafluoropropane | 27 |
| Octafluorocyclopentene | 26 |
| 2-Bromo-1,1,1-trifluoroethane | 25 |
| Dibromodifluoromethane | |

Those compounds mentioned above which have unsaturated bonds pose potential health threats and must be applied using appropriate protective measures. In addition to the use of halocarbons may be mentioned the use of suitable hydrocarbons, such as 2-Methylbutane, 1-Pentene and volatile silicon-containing liquids characterized by boiling points within the teachings of the instant invention. Despite their limitations for general applications, which are noted in parentheses, 1,1,1-Trifluoroacetone (high toxicity, high solvent power), ethyl chloride (extremely flammable, frostbite risk) and methyl formate (relatively high polarity) may also be mentioned as being useful for special applications or may be used in minor proportions in combination with other preferred solvents of the instant invention.

The concentration of dissolved fluorescent organic compound in the volatile solvents of this invention should be sufficient to impart a readily detectable fluorescent mark under UV light on the material being treated and allow for ready transfer to a thief's fingers upon contact, and most desirably upon light contact. The exact concentration is dependent upon a number of factors, including the fluorescent intensity of the fluorescent organic compound, the characteristics (such as fluorescence, texture, porosity, color) of the surface being treated, the desired degree of transfer, limitations imposed by the maximum quantity of a fluorescent compound or combination of fluorescent compounds which will dissolve in a given quantity of volatile solvent or a mixture of volatile solvents (including an azeotropic or nonazeotropic mixture of an active solvent capable of dissolving the fluorescent compound and a nonsolvent diluent, which may be a perfluorinated liquid having a boiling point within the range of the instant invention), and the white-light color of the fluorescent organic compound. A range of between about 0.01% w/v to the saturation point may be mentioned. As a general rule, the closer to the saturation point, the greater the quantity of fluorescent compound that will precipitate on the surface of the item being treated. In some cases, such as manila envelopes which do not contain appreciable amounts of fluorescent brighteners and have essentially no observable fluorescence under UV light, very low concentrations of the selected fluorescent compound or combination of compounds will impart a satisfactory signal and suitable transfer. On the other hand, papers and fabrics which contain brighteners or fluorescent dyes will require higher levels of fluorescent compounds for a readily detectable signal to be observed under UV light. In some circumstances the concentration of fluorescent compound can be reduced so that there is virtually no transfer of fluorescent compound to fingertips and other surfaces.

It is also within the scope of this invention to utilize supersaturated solutions of fluorescent organic compounds and to incorporate minor percentages of solvents which have boiling points or distillation ranges which slightly exceed 35° C., as cosolvents in order to dissolve selected fluorescent organic compounds.

Having provided a description of the invention, the following examples are given to more fully illustrate the teachings of the invention. The examples are not intended to limit the scope of the invention.

EXAMPLE 1

0.27 g of 2-(o-Hydroxyphenyl)benzothiazole was dissolved in 30 milliliters (approximately 0.68% weight/weight; 0.9% weight/volume) of Dichloromethane, a volatile organic solvent which has a literature boiling range at 760 mm Hg of between 39.8°–40.0°C. and is a solvent for the organic fluorescent compound. Approximately 3 milliliters was poured over a dollar bill from a height of 3 inches at room temperature. The solvent evaporated in approximately 45 seconds. No sign of treatment was apparent under white light; under long wave UV light, a strong fluorescent signal was observed. When two fingertips were lightly passed over treated portions of the bill and then examined under UV light, virtually no fluorescent powder was observed on the fingertips. This example serves to illustrate the critical limitations which result from the use of a solvent with a boiling range above the upper limits of this invention.

EXAMPLE 2

0.27 g of 2-(o-Hydroxyphenyl)benzothiazole was dissolved with stirring in 30 milliliters (approximately 0.6% weight/weight; 0.9% weight/volume) of Fluorotrichloromethane, a volatile organic solvent which has a literature boiling point of 23.7° C. and is a solvent for the organic fluorescent compound. Approximately 3 milliliters was poured over a dollar bill from a height of 3 inches at room temperature. In about 15 seconds the solvent evaporated. No sign of treatment was apparent under white light; under longwave UV light, a very strong fluorescent signal was observed. When two fingertips were lightly passed over treated portions of the bill and then examined under UV light, a very strong green fluorescent signal was observed under longwave UV light; under white light, there was no visible residue on the fingertips.

Further, the fingertips which contacted treated portions of the bill were in turn contacted with dark clothing, an amber bottle and a leather wallet. In all cases, the fluorescent powder was transferred to the objects. This example is illustrative of a preferred embodiment of the invention.

EXAMPLE 3

A 0.6% w/w solution (0.9% weight/volume) of 2-(o-Hydroxy-5-methoxyphenyl)benzothiazole was prepared in Fluorotrichloromethane. The fluorescent solution was applied as described in examples 1 and 2. Following evaporation of the solvent, a moderately strong orange signal was observed under longwave UV light on treated areas of the dollar bill. There was no sign of treatment on examination under white light. The powder readily transferred to fingertips on glancing contact where it was plainly visible under UV light, but not under white light. This example is illustrative of the use of a 2-(o-Hydroxyphenyl)benzothiazole derivative in the practice of the invention.

EXAMPLE 4

A 1.34 w/w (2.01 weight/volume) solution of 2-(o-Hydroxyphenyl)benzoxazole was prepared in Fluorotrichloromethane. The fluorescent solution was applied as described in examples 1 and 2. Following evaporation of the solvent, a strong blue-green fluorescent signal was observed under longwave UV light on treated areas of the dollar bill. There was no sign of treatment under white light. On light, glancing contact the powder readily transferred to fingertips and was plainly visible under longwave UV light, but not under white light. This example illustrates the use of a benzoxazole derivative in accordance with the teachings of the invention.

EXAMPLE 5

A 0.46% w/w (approx. 0.58% weight/volume) solution of 2-(o-Hydroxyphenyl)benzothiazole was prepared in the hydrochlorofluorocarbon 1,1-Dichloro-1-fluoroethane. The fluorescent solution was applied to currency as described in examples 1 and 2. In addition, the solution was poured over white bond paper (Southworth Stock no. 403C). Treated papers were fanned in the air for 10 seconds until dry. While no sign of treatment was evident on unaided examination, a strong green fluorescent signal was observed under both short and longwave UV light. Glancing contact resulted in very slight transfer of the fluorescent agent to fingertips; repeated handling resulted in good transfer to the fingertips. The transfer was undetectable without the use of UV light. This example serves to illustrate the use of a hydrochlorofluorocarbon in the practice of the invention and the use of a low concentration of fluorescent compound to limit transfer only upon repeated contact or aggressive frictional contact.

EXAMPLE 6

A 1.2% w/w (1.77% weight/volume) solution of 2-(o-Hydroxyphenyl)benzothiazole was prepared in the hydrochlorofluorocarbon 2,2-Dichloro-1,1,1-Trifluoroethane. The solution was applied to currency and bond paper as described in examples 1 and 2. In addition a dollar bill was immersed for five seconds in the solution, then allowed to air dry. In each case, no sign of treatment was evident to the unaided eye, while UV examination revealed a strong green fluorescent signal on treated portions. The fluorescent residue readily transferred to dry fingertips upon light handling where it was detectable under UV examination only. After repeated handling, the fluorescent powder continued to transfer without significantly diminishing the fluorescent intensity on the respective paper surfaces. This example serves to illustrate additional application techniques and the use of a hydrochlorofluorocarbon in the practice of the invention.

EXAMPLE 7

Using the hydrochlorofluorocarbon of example 6, a solution having a strength of 1.6% w/w (2.36% weight/volume) of 2-(o-Hydroxyphenyl)benzothiazole was prepared with vigorous stirring. A wool dauber was immersed in the solution and while still wet, was rubbed over the face of a dollar bill and bond paper. No damage to the respective papers was noted and the fluorescent residue transferred readily to fingertips in light frictional contact. The areas of the papers which were handled retained their intense fluorescent character. In a variant, the instant solution was poured over a KLEENEX tissue. The tissue was allowed to dry and return to room temperature whereupon it was used as a fluorescent "duster" to impart finely precipitated fluorescent powder to a wide variety of wiped surfaces, including papers, plastics, glass, metals, and fabrics. This example serves to further illustrate the use of a hydrochlorofluorocarbon.

EXAMPLE 8

A w/w solution of approximately 0.9% (approx. 0.58% weight/volume) of 2-(o-Hydroxyphenyl)benzothiazole in 1-Pentene was prepared. The solution was applied to currency as described in example 2, with very similar results. Since 1-Pentene is miscible in all proportions with most of the preferred fluorocarbons as described herein, suitable solutions may comprise a mixture of 1-Pentene and one or more of the recited fluorocarbons. This example illustrates the use of a hydrocarbon solvent in the practice of the instant invention.

I claim:

1. A method of marking a porous web with a fluorescent material and detecting the transference of the fluorescent material onto a second surface following contact with the marked porous web, said method comprising the steps of:

(1) applying to a porous web a solution consisting essentially of from about 0.05 to about 2.5 of solvent-soluble, organic fluorescent compound dissolved in 100 ml of an organic solvent having a boiling point of distillation range at 760 mmHg of between about 15° C. and 35° C., thereby providing a fluorescent residue on the porous web that is non-color contributing under white light, essentially invisible to the unaided eye without ultraviolet illumination, is visualized under ultraviolet light, and is readily transferred on contact in a quantity sufficient for detection under ultraviolet light from the porous web to a second surface; and (2) irradiating a surface believed to have come into contact with the porous web with ultraviolet light to visualize and detect any fluorescent residue on the irradiated surface.

2. The method of claim 1 wherein the solution is applied to the porous web by pouring, immersion, brushing, daubing, swabbing, wiping or spraying.

3. The method of claim 1 wherein the porous web is paper, currency, a woven or a nonwoven fabric.

4. The method of claim 1 wherein said fluorescent compound is 2-(o-hydroxyphenyl)benzothiazole, 2-(o-hydroxyphenyl)benzoxazole or 2-(2-hydroxyphenyl)-4-(3)-quinazolone.

5. The method of claim 1 wherein the solution contains from about 0.05% to about 1.4% weight/volume of the fluorescent compound.

6. The method of claim 1 wherein the solvent is a hydrocarbon solvent.

7. The method of claim 1 wherein the solvent is fluorotrichloromethane, 1,1-dichloro-1-fluoromethane or 2,2-dichloro-1,1,1-trifluoroethane.

8. A method of rendering a porous web fluorescent whereby fluorescent residue will readily transfer from said porous web to other surfaces by contact, said method comprising:

(a) applying to said web a solution consisting essentially of from about 0.05 to about 2.5 grams of an organic solvent-soluble, organic fluorescent compound dissolved in 100 millimeters of an organic solvent having a boiling point or distillation range at 760 mmHg of between about 15° and 35° C., and thereafter (b) contacting the thus-treated porous web with another surface thereby transferring the fluorescent residue to said second surface.

9. The method of claim 8 wherein the solvent is a hydrocarbon solvent.

10. The method of claim 8 wherein the solvent is fluorotrichloromethane, 1,1-dichloro-1-fluoromethane or 2,2-dichloro-1,1,1-trifluoroethane.

* * * * *